US005680004A

United States Patent [19]

Ragland, Jr.

[11] Patent Number: 5,680,004

[45] Date of Patent: Oct. 21, 1997

[54] COLOR PICTURE TUBE HAVING AN IMPROVED SHADOW MASK-TO-FRAME CONNECTION

[75] Inventor: Frank Rowland Ragland, Jr., Lancaster, Pa.

[73] Assignee: Thomson Consumer Electronics, Inc., Indianapolis, Ind.

[21] Appl. No.: 578,868

[22] Filed: Dec. 28, 1995

[51] Int. Cl.[6] ..... H01J 29/07

[52] U.S. Cl. ..... 313/405; 313/407

[58] Field of Search ..... 313/402, 405, 313/403, 404, 407, 408

[56] References Cited

U.S. PATENT DOCUMENTS

| | | | |
|---|---|---|---|
| 3,524,973 | 8/1970 | Ragdon | 313/405 |
| 3,808,493 | 4/1974 | Kawamura et al. | 313/85 S |
| 4,638,211 | 1/1987 | Fonda | 313/405 |
| 4,678,963 | 7/1987 | Fonda | 313/405 |
| 4,707,633 | 11/1987 | Hoshi | 313/404 |
| 5,252,889 | 10/1993 | Choi | 313/404 |

*Primary Examiner*—Michael Horabik
*Assistant Examiner*—Michael Day
*Attorney, Agent, or Firm*—Joseph S. Tripoli; Dennis H. Irlbeck

[57] ABSTRACT

An improved color picture tube includes an evacuated glass envelope having a rectangular faceplate panel. The panel includes a shadow mask assembly mounted therein. The shadow mask assembly includes a shadow mask formed from a first metal having first coefficient of thermal expansion and a frame formed from a second metal having a second coefficient of thermal expansion. The first coefficient of thermal expansion is substantially lower than the second coefficient of thermal expansion. The improvement comprises the shadow mask being interconnected with the frame by a plurality of bimetallic elements, each of the elements having a first end attached to the frame and a second end attached to the mask. Each bimetallic element is formed of materials that cause a bending of the element an amount related to the thermal expansion of the frame.

6 Claims, 2 Drawing Sheets

COLOR PICTURE TUBE HAVING AN IMPROVED SHADOW MASK-TO-FRAME CONNECTION

This invention relates to color picture tubes of the type having a shadow mask attached to a peripheral frame which is suspended in relation to a cathodoluminescent screen and, particularly, to improved means for connecting a shadow mask, constructed of a first material, to a frame, constructed of a second material, wherein the first and second materials have substantially different coefficients of thermal expansion.

BACKGROUND OF THE INVENTION

In most current color picture tube types, a peripheral steel frame supporting a steel shadow mask is suspended in a faceplate panel by means of springs that are welded either directly to the frame or to plates which in turn are welded to the frame. In the directly welded version, the springs are usually made of bimetallic materials; and in the plate version, the plates are bimetallic. As the springs or plates become heated by transfer of heat from the mask through the frame, the bimetallic materials expand differently, thereby bending the springs or plates to cause movement of the mask-frame assembly toward a screen disposed on the panel. However, in tubes having shadow masks made from materials having low coefficients of thermal expansion, such as Invar, there is very little expansion of the masks during tube operation. Because of the low expansion of Invar shadow masks, the bimetallic support springs and/or bimetallic plates are not necessary. However, because of cost factors, the support frames usually are not made from low expansion materials, thus creating a problem caused by the difference in expansion of the different materials forming the mask and frame.

A shadow mask includes a central apertured portion, through which electron beams pass, and a peripheral skirt portion that surrounds the apertured portion. In a color picture tube, wherein a shadow mask of low expansion material, such as Invar, is used with a steel mask support frame, the difference in thermal expansion between the mask and the frame causes the mask skirt to move outwardly relative to the rest of the mask when the frame and mask temperatures are elevated. Temperature elevations occur both during tube operation and during tube processing. Tube processing temperatures exceed 400° C. and can cause the mask to be permanently distorted. The relative movement that occurs within the mask takes place in the region where the skirt is in contact with the frame, although the two may not be attached. The effect of the skirt motion caused by contact with the frame is local and may not extend more than 3 cm from the point of contact; however, the contact can cause a localized change in the contoured surface of the mask, which in turn causes misalignment between the mask apertures and their corresponding phosphor stripes or dots of the screen. The appearance of the misalignment is similar to that of a small dent in the shadow mask. The magnitude of the apparent dent is dependent upon skirt length and mask contour, among other factors. Flatter mask contours are more susceptible to this occurrence than are more curved contours.

The present invention provides an improvement in the shadow mask-to-frame connection where the shadow mask is constructed of a first material, the frame is constructed of a second material, and the first and second materials have substantially different coefficients of thermal expansion.

SUMMARY OF THE INVENTION

The improved color picture tube includes an evacuated glass envelope having a rectangular faceplate panel. The panel includes a shadow mask assembly mounted therein. The shadow mask assembly includes a shadow mask that is formed from a first metal having a first coefficient of thermal expansion, and a frame that is formed from a second metal having a second coefficient of thermal expansion. The first coefficient of thermal expansion is substantially lower than the second coefficient of thermal expansion. The improvement comprises the shadow mask being interconnected with the frame by a plurality of bimetallic elements, each of the elements having a first end attached to the frame and a second end attached to the mask. Each bimetallic element is formed of materials that cause a bending of the element of an amount related to the thermal expansion of the frame.

DETAILED DESCRIPTION OF THE PREFERRED EMBODIMENTS

Figure 1:
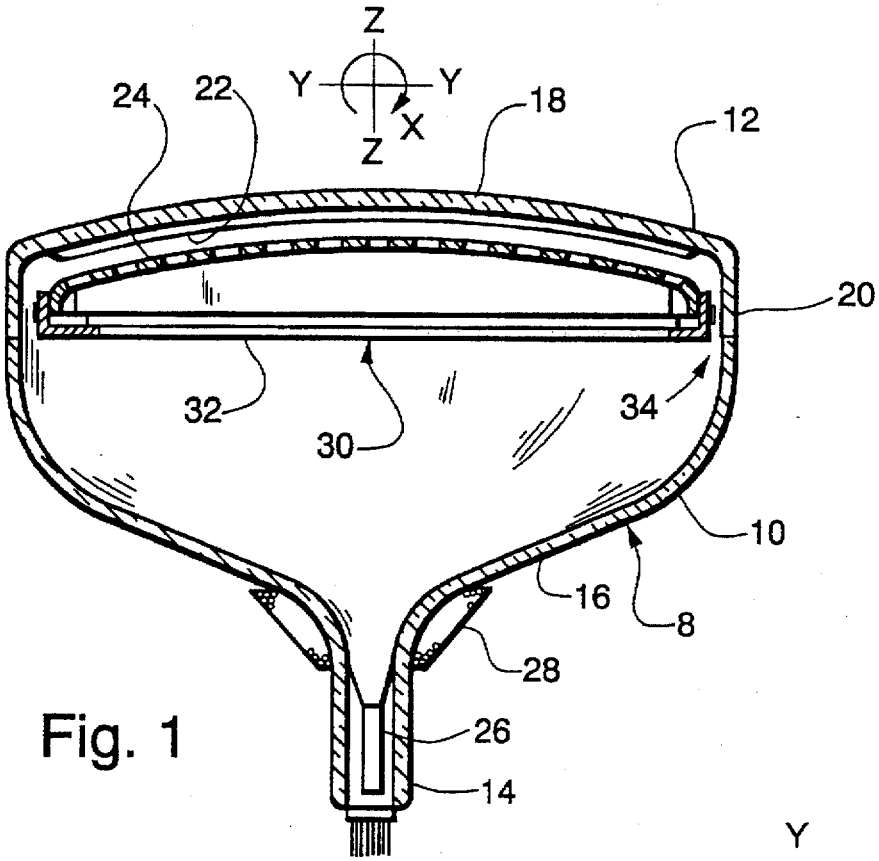
FIG. 1 is an axially sectioned side view of a color picture tube embodying the present invention.

FIG. 1 shows a rectangular color picture tube 8 having a glass envelope 10, comprising a rectangular faceplate panel 12 and a tubular neck 14 connected by a rectangular funnel 16. The panel 12 comprises a viewing faceplate 18 and a peripheral flange or sidewall 20 sealed to the funnel 16. The faceplate panel 12 includes two orthogonal axes: a major axis X, parallel to its wider dimension (usually horizontal), and a minor axis Y, parallel to its narrower dimension (usually vertical). The major and minor axes are perpendicular to a central longitudinal axis Z of the tube which passes through the center of the neck 14 and the center of the panel 12. A mosaic three-color phosphor screen 22 is carried by the inner surface of the faceplate 18. The screen preferably is a line screen with the phosphor lines extending substantially parallel to the minor axis Y. Alternatively, the screen may be a dot screen. A multiapertured color selection electrode or shadow mask 24 is removably mounted, by improved means, in predetermined spaced relation to the screen 22. An electron gun 26 is centrally mounted within the neck 14, to generate and direct three electron beams along convergent paths through the mask 24 to the screen 22.

The tube of FIG. 1 is designed to be used with an external magnetic deflection yoke, such as the yoke 28, located in the vicinity of the funnel-to-neck junction. When activated, the yoke 28 subjects the three beams to magnetic fields which cause the beams to scan horizontally and vertically in a rectangular raster over the screen 22.

Figure 2:
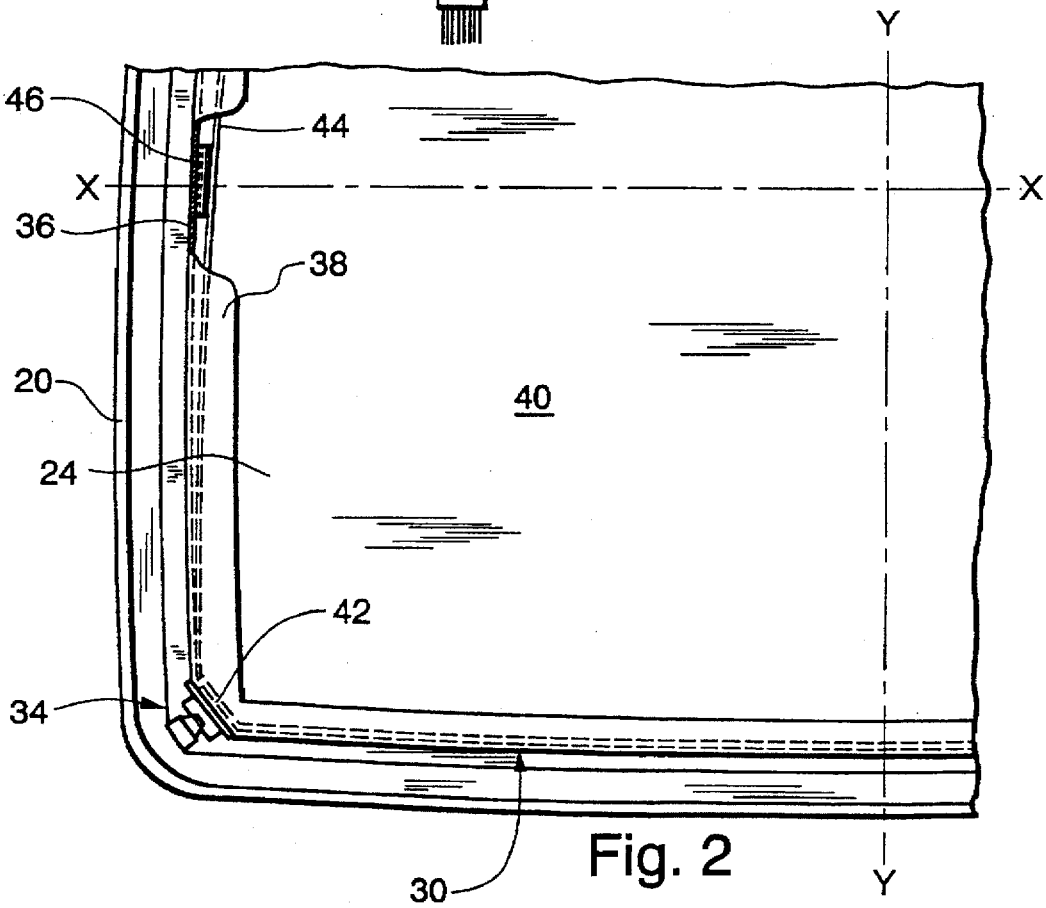
FIG. 2 is a bottom view of a quadrant of the faceplate panel and mask-frame assembly of the tube of FIG. 1.
Figure 3:
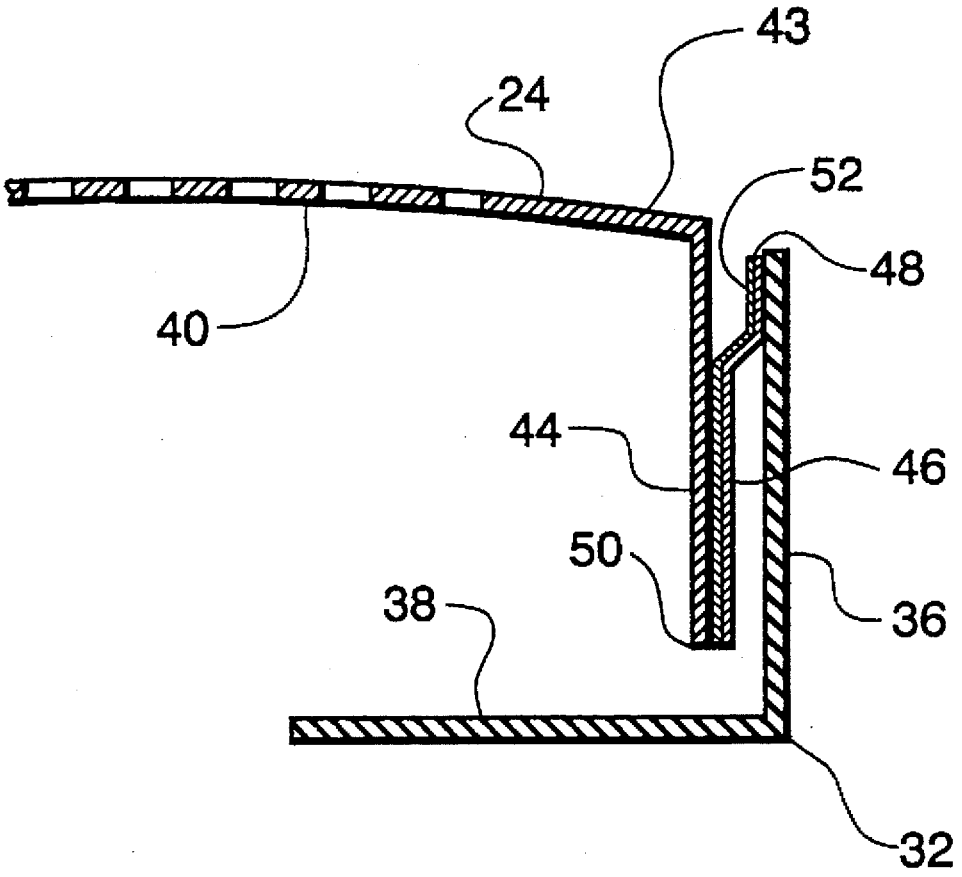
FIG. 3 is a cross-sectional view of a side of the shadow mask-frame assembly of FIG. 2.

The shadow mask 24 is part of a mask-frame assembly 30 that also includes a peripheral frame 32. The mask-frame assembly 30 is shown mounted within the faceplate panel 12 by means of spring supports 34 in FIGS. 1 and 2 and is shown in cross-section also in FIG. 3.

The frame 32 includes two substantially perpendicular flanges, a first flange 36 and a second flange 38, in an L-shaped cross-sectional configuration. The first flange 36 extends from the second flange 38 in a direction toward the screen 22. The second flange 38 extends from the first flange 36 in a direction toward the central longitudinal axis Z of the tube 8. The four corners 42 of the frame 32 are truncated, being angled approximately perpendicularly to the diagonal directions of the frame. Alternatively, the present invention may also be applied to a tube having on-axis or off-corner mask-frame assembly spring supports.

The shadow mask 24 includes a curved apertured portion 40, an imperforate border portion 43 surrounding the apertured portion 40, and a skirt portion 44 bent back from the border portion 42 and extending away from the screen 22. The mask 24 is telescoped within, i.e., set inside, the frame 32 and is interconnected to the frame 32 by means of bimetallic elements 46.

In a preferred embodiment, the shadow mask 24 is constructed from the iron-nickel material Invar and the mask is constructed from steel. The coefficient of thermal expansion of Invar is much lower than is the coefficient of thermal expansion of steel. By placing laminated bimetallic elements 46 between an Invar shadow mask and a steel support frame, the effective difference in expansion between the mask and frame can be nullified. Each bimetallic element 46 has a first end 48 attached to the distal end of the vertical first flange 36 of the frame 32 and a second end 50 attached to the distal end of the mask skirt portion 44. The lower expansion side 52 of the bimetallic element 46 faces the mask skirt portion 44. As the temperatures of the mask, the bimetallic elements and the frame increase, the frame moves away from the mask, but the bimetallic elements bend to move the ends of the elements attached to the mask away from the frame. This bending prevents excess force on the mask skirt which may result in at least a temporary denting of the mask, while maintaining the position of the mask within the faceplate panel.

Although the bimetallic elements can be applied at several locations along each side of the mask and frame, it is usually necessary to apply them only at the ends of the major axis. The design of the bimetallic elements may be varied by changing their thicknesses and material constituents. Ideally, the materials selected should cause a bending of the bimetallic element of an amount that is related to the thermal expansion of the frame, so as to prevent distortion of the mask skirt and to substantially maintain at least the horizontal position of the shadow mask relative to the panel when the frame is subjected to thermal expansion. In one embodiment, the formed dimensions of the bimetallic elements are 19 mm by 28.5 mm 1 mm thick, and the elements consist of two materials of equal thickness. One of these bimetal materials is composed of 36% Ni and 64% Fe, and the other bimetal material is composed of 22% Ni, 3% Cr and 75% Fe. The bimetallic element also includes an offset of about 0.5 mm near the end that is attached to the frame, so that the bimetallic action is not impeded by uncontrolled contact with the frame.

When the bimetallic elements 46 are used with an Invar mask, it is preferred to make the sides 52 of the elements that contact the mask also out of Invar, so that there will be no mismatch between them. This is desirable because although Invar has a relatively low expansion rate up to about 200° C., its expansion rate above 200° C. is much higher, approaching that of iron. Because processing steps raise the temperature of a tube to about 400° C., elimination of any mismatch of materials prevents distortions or fractures of the attachment between the elements and the mask.

What is claimed is:

1. In a color picture tube including an evacuated glass envelope having a rectangular faceplate panel, wherein the panel includes a shadow mask assembly mounted therein and the shadow mask assembly includes a shadow mask that is formed from a first metal having a first coefficient of thermal expansion and a frame formed from a second metal having a second coefficient of thermal expansion, the first coefficient of thermal expansion being substantially lower than the second coefficient of thermal expansion, the improvement comprising said shadow mask being solely interconnected with said frame by a plurality of bimetallic elements, each of said elements having a first end attached to an inside surface of said frame and a second end attached to an outside surface of said mask, each bimetallic element being formed of materials that cause a bending of said element an amount related to the thermal expansion of said frame, and wherein the materials forming said bimetallic elements include two materials having different coefficients of thermal expansion, with the material having the higher coefficient of thermal expansion being in contact with said frame and the material having the lower coefficient of thermal expansion being in contact with said mask.

2. The tube as defined in claim 1, wherein the material forming said mask and the lower expansion material of said bimetallic elements are the same material.

3. The tube as defined in claim 2, wherein said mask and said lower expansion sides of said bimetallic elements are of the nickel-iron material Invar.

4. In a color picture tube including an evacuated glass envelope having a rectangular faceplate panel, wherein the panel includes a shadow mask assembly mounted therein and the shadow mask assembly includes a shadow mask that is formed from a first metal having a first coefficient of thermal expansion and a frame formed from a second metal having a second coefficient of thermal expansion, the first coefficient of thermal expansion being substantially lower than the second coefficient of thermal expansion, the improvement comprising said shadow mask being solely interconnected with said frame by a plurality of bimetallic elements, each of said elements having a first end attached to said frame and a second end attached to said mask, each bimetallic element being formed of materials that cause a bending of said element an amount related to the thermal expansion of said frame, and wherein said shadow mask is positioned within said frame and each bimetallic element is formed of materials that cause an overall bending of said element inwardly toward said mask during heating.

5. The tube as defined in claim 4, wherein said shadow mask includes a peripheral skirt surrounding an apertured portion of said mask and the materials of each bimetallic element are selected to prevent distortion of said mask skirt when said frame is subjected to thermal expansion.

6. The tube as defined in claim 4, wherein said shadow mask includes a peripheral skirt surrounding an apertured portion of said mask and the frame includes two perpendicular flanges, and said first ends of said elements are attached to the distal end of one of said flanges and the second ends of said elements are attached to the distal end of said skirt.

* * * * *